US006295753B1

(12) United States Patent
Thummel

(10) Patent No.: US 6,295,753 B1
(45) Date of Patent: Oct. 2, 2001

(54) LASER PRECISION BORE SIGHT ASSEMBLY

(75) Inventor: Heinz F. Thummel, Salinas, CA (US)

(73) Assignee: Laser Devices, Inc., Monterey, CA (US)

( * ) Notice: Subject to any disclaimer, the term of this patent is extended or adjusted under 35 U.S.C. 154(b) by 0 days.

(21) Appl. No.: 09/504,967

(22) Filed: Feb. 15, 2000

(51) Int. Cl.[7] ..... F41A 33/02
(52) U.S. Cl. ..... 42/116
(58) Field of Search ..... 42/76.01, 84, 85, 42/95, 106, 116

(56) References Cited

U.S. PATENT DOCUMENTS

| | | | | |
|---|---|---|---|---|
| 4,825,258 | * | 4/1989 | Whitson | 356/153 |
| 4,926,607 | * | 5/1990 | Baldwin | 42/95 |
| 5,365,669 | * | 11/1994 | Rustik | 33/234 |
| 5,432,598 | * | 7/1995 | Szatkowski | 42/116 |
| 5,448,834 | * | 9/1995 | Huang | 42/116 |
| 5,454,168 | * | 10/1995 | Langner | 42/116 |
| 5,486,913 | * | 1/1996 | Aharon | 356/153 |
| 5,618,099 | * | 4/1997 | Brubacher | 42/116 |

* cited by examiner

*Primary Examiner*—Charles T. Jordan
*Assistant Examiner*—Elizabeth Shaw
(74) *Attorney, Agent, or Firm*—Patrick T. King

(57) ABSTRACT

A laser precision bore sight assembly and method aligns a laser beam along the longitudinal axis of a gun barrel. At the proximate end of an elongated bore shaft is rotatably mounted a compressible barrel insert with a continuous outer surface which resiliently engages the inside wall of the gun barrel to coaxially align the longitudinal axis of the proximate end of the shaft with the longitudinal axis of the gun barrel. The exterior surface of an alignment cone is provided on the distal end of the bore shaft. A battery/switch housing, containing a switch assembly, cooperates with a laser housing assembly to provide an enclosure for a battery. A laser source in the laser housing assembly provides a laser beam in a direction coaxial with the longitudinal axis of the shaft. Matching threads provide for relative longitudinal movement such that a terminal of the battery engages the switch assembly to activate the laser source. The compressible barrel-shaped insert is a cylinder formed of a machined acetal material. Different sizes of compressible barrel inserts are provided for different gun-barrel calibers. A three point laser alignment mechanism directs the laser beam along the longitudinal axes of the shaft and the bore of the gun barrel, even when the shaft is rotated. The invention also provides a method for aligning a laser beam along the longitudinal axis of the bore of a gun barrel.

38 Claims, 11 Drawing Sheets

LASER PRECISION BORE SIGHT ASSEMBLY

BACKGROUND OF THE INVENTION

1. Field of the Invention

This invention relates to techniques for calibration of gun sights and, more particularly, to a laser precision bore sight assembly.

2. Prior Art

Previously, several different systems have been used for calibration of gun sights. To obtain an accurate alignment of a weapon bore sight or of a training device attached to a weapon, the first step in using a bore sight device is to rotate the bore sight device a minimum of 360 degrees to confirm that the alignment of the bore sight is concentric to the bore of the weapon. If the laser point that is projected from the bore sight device onto a target 10 meters away traces a circle on the target, then the axis of the bore sight device is not concentric with the bore of the weapon.

One type of alignment device, as disclosed in U.S. Pat. No. 4,825,258, uses a light source, such as a laser, which is coaxially mounted outside of the gun barrel on the outer end of a hollow cylindrical metal rod, the inner end of which extends into the bore of a gun barrel. The outer end of the hollow cylindrical rod is a larger cylinder which engages the inside wall of the gun barrel. The inner end of the hollow rod is smaller in diameter than the bore of the gun barrel and has an expandable, split end formed into a number of longitudinal metal fingers. The free ends of the longitudinal fingers are expanded outwardly using a cone-shaped mandrel which is drawn into the metal fingers with a screw which extends out through the hollow rod mechanism to force the cone-shaped mandrel into the fingers. In this manner, the ends of the metal fingers are pushed outwardly to engage the inner wall of the bore of the gun barrel. This arrangement is supposed to fix the inner end of the rod in position in the bore of the gun barrel and to maintain the axis of the rod in alignment with the axis of the bore of the gun barrel.

Note that, this type of a system can be rotated prior to the metal fingers engaging the walls of the gun barrel, but the fit of the fingers is too loose to maintain concentric alignment. If the metal fingers fully contact the barrel, the fingers catch upon the rifling grooves making it difficult to rotate the device while maintaining concentric alignment of a laser beam. When this arrangement is axially rotated in the gun barrel, some of the metal fingers engage the rifling grooves formed in the inside walls of the gun barrel while other metal fingers directly engage the walls of the gun barrel, which causes the inner end of a rotated rod to change its alignments in the gun barrel. The type of metal material used for the fingers also has an effect of the performance of such an arrangement. Use of a material, which is softer than the hard steel of a gun barrel, such as brass, results in wear of the metal fingers and uneven alignment of the metal fingers within the gun barrel so that the inner end of the rod does not remain coaxially aligned with the gun barrel. On the other hand, use of a harder material for the metal fingers results in wear and damage to the rifling within the gun barrel.

U.S. Pat. No. 5,365,669 discloses another system which uses a laser light source mounted in a cartridge-shaped housing that is contained in a cartridge chamber of a gun. This system is not adjustable and is subject to the axial offsets and misalignments between the axis of the cartridge chamber and the axis of the bore of the gun barrel.

What is needed is a system which maintains direct coaxial alignment of a laser light source along the axis of the bore of a gun barrel, particularly when that laser light source is axially rotated.

SUMMARY OF THE INVENTION

The present invention provides a bore sight assembly which is used for aligning optical scopes, mechanical firearm sights, laser sighting devices, firearm training systems, or other devices that are aligned with a target point, such that a projectile or a simulated projectile fired from a weapon or a training device strikes the target point. The present invention provides a precision bore sight alignment assembly which remains in coaxial alignment with the axis of the bore of a gun barrel, particularly when the rod is rotated within the gun barrel, to thoroughly maintain concentric alignment of an alignment laser beam.

The present invention provides a laser precision bore sight system for bore sight alignment of a laser beam along the longitudinal axis of a gun barrel. As mentioned above, this system is suitable for alignment of various types of weapon sights. This system is also suitable for simulating firing of a weapon in a training system using a laser beam to simulate the path of an actual projectile or bullet.

A system according to the invention includes an elongated bore shaft with a longitudinal axis. The bore shaft is adapted to having its proximate end inserted into the bore of the gun barrel. At the proximate end of the elongated shaft is rotatably mounted a compressible barrel insert which has a continuous outer surface. The barrel insert is adapted to be inserted in the gun barrel so that the outer surface thereof resiliently engages the inside wall of the gun barrel. In this way the longitudinal axis of the proximate end of the bore shaft is coaxially aligned with the longitudinal axis of the gun barrel.

The distal end of the bore shaft is also coaxially aligned with the axis of the gun barrel. One embodiment of the invention includes an alignment cone which is fixed to the distal end of the bore shaft. The surface of the alignment cone increases in diameter as it extends distally away from the bore shaft. Depending on the caliber of the gun, a certain area of the conical surface of the alignment cone engages the distal inner edge of the gun barrel. In this way the distal end of the shaft is aligned with the longitudinal axis of the gun barrel.

Coaxially mounted adjacent to the alignment cone is a battery/switch housing which contains a switch assembly. A laser housing assembly is coaxially mounted adjacent to the battery/switch housing and contains a laser subassembly having a laser source which provides a laser beam in a direction coaxial with the longitudinal axis of the shaft. The battery/switch housing and the laser housing assembly have longitudinal end bores formed therein to provide an enclosure for a battery. The battery/switch housing and the laser housing assembly also have corresponding matching threads formed thereon to provide for relative longitudinal axial movement therebetween when they are rotated with respect to each other such that a terminal of the battery engages the switch assembly to activate the laser source.

In one preferred embodiment of the invention, the compressible barrel insert is a cylinder formed of a machined acetal material. In one preferred embodiment, the compressible cylindrical barrel insert is rotatably mounted on the cylindrical bearing surface of a barrel insert retainer shaft which is coaxially screwed to the end of the elongated shaft.

To accommodate a number of gun barrel sizes, the compressible barrel insert is selected from a group of cylindrical barrel inserts, corresponding to a particular gun-barrel caliber.

The laser housing assembly also includes a three point laser alignment mechanism for adjusting the alignment of the laser subassembly so that the laser beam is directed along the longitudinal axes of the shaft and the bore of the gun barrel when the shaft is rotated. One preferred embodiment of the three-point alignment mechanism includes fixed adjustments made at a factory or a service station. Another preferred embodiment of the three-point alignment mechanism is manually adjustable by a user in the field and includes two manually adjustable screw mechanisms, the ends of which contacts the laser subassembly and a spring-loaded bushing, which is fixed to a set screw and which biases the laser subassembly against the first and the second manually adjustable adjustment screws. The two manual adjustment screw mechanisms each includes a fine adjustment screw which moves radially with respect to the axis of the shaft and a detent mechanism provides for stepped manual adjustment of the adjustable screws.

The battery/switch housing switch assembly is contained in a cavity formed in a battery/switch housing and includes a compression spring having flat ends and contained within the cavity. A cup-shaped fiber washer has a center bore formed therethrough to receive a contact pin which is a flat-head brass screw or a smooth sided pin, both with a conical head and an end contact surface. The contact pin is held in the center bore of the fiber washer with the head of the pin on one wide of the fiber washer and a nickel-plated washer on the other side of the fiber washer. A solder blob covers the top surface of the conical head to serve as a contact area for the positive terminal of a battery. The contact pin is soldered to the nickel plated washer. Relative twisting of the battery/switch housing with respect to the laser housing assembly pushes the positive battery terminal into the head of the contact pin such that the contact end of the contact pin contacts the housing to activate the laser source.

The barrel-shaped insert includes a cylindrical base, which is rotatably mounted to the shaft and an attached radially resilient section which resiliently positions the axis of the end of the shaft along the longitudinal axis of the gun barrel. In one preferred embodiment of the invention, the radially resilient section has a peaked cylindrical area which has a maximum diameter which is greater than the diameter of the gun barrel such that when the barrel-shaped insert is inserted into the gun barrel, the external surface of peaked cylindrical area contacts the interior wall of the gun barrel and is pushed radially inwardly to conform to the smaller diameter of the gun barrel. The peaked cylindrical area of the barrel insert snugly engages the wall of the gun barrel to precisely position the one end of the shaft within the gun barrel along the longitudinal axis of the gun barrel and the peaked cylindrical area of the barrel insert provides continuously contact with the inner wall of the gun barrel in spite of the rifling grooves formed in the gun barrel and the tough material of the barrel insert does not damage the interior surface or the rifling of the gun barrel.

One embodiment of the radially resilient barrel-shaped insert has a section which has an interior diameter larger than the interior diameter of the cylindrical base section and a peaked cylindrical area with a maximum diameter which is greater than the diameter of the gun barrel.

Another embodiment of the radially resilient section includes an integral radially outwardly extending support flange from which longitudinally extends an integral cantilevered resilient ring with a peaked cylindrical area which has a maximum diameter greater than the diameter of the gun barrel to prove a snug fit within the barrel of a gun. The integral cantilevered resilient ring is spaced apart from the main cylindrical section and has a ring-shaped space formed beneath it.

The three-point alignment mechanism mounted to the universal housing for adjusting the alignment of the laser subassembly includes two orthogonally aligned adjustable screw mechanisms and a spring-loaded bushing aligned for movement in a direction to bias the laser subassembly against the ends of the first and the second adjustment screws.

A fine adjustment retainer ring has a number of pairs of opposing internal recesses formed therein which are engaged by at least one spring-loaded ball to provide stepped adjustments.

The invention also provides a method for aligning a laser beam along the longitudinal axis of the bore of a gun barrel and includes the following steps: rotatably mounting a cylindrical barrel insert, which has a flexible outer cylindrical surface, to one end of a shaft having a longitudinal axis; inserting the cylindrical barrel insert into the bore of the gun barrel having a longitudinal axis and engaging the inside wall of the gun barrel bore with the outer cylindrical surface of the cylindrical barrel insert; engaging an alignment cone located at the outer end of the shaft with the outer inside edge of the gun barrel such that the longitudinal axis of the shaft is coaxially aligned with the longitudinal axis of the gun barrel when the shaft is inserted and rotated in the gun barrel; mounting a laser housing, which contains a laser source assembly, to the outer end of the shaft; directing a laser beam from the laser source assembly in a direction coaxial with the longitudinal axis of the shaft; and adjusting a three point laser alignment mechanism mounted to the universal housing for adjusting and truing the alignment of the laser beam along the longitudinal axes of the shaft and the bore of the gun barrel, even when the shaft is rotated.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it should be understood that they are not intended to limit the invention to these embodiments. On the contrary, the invention is intended to cover alternatives, modifications and equivalents, which are included within the spirit and scope of the invention as defined by the appended claims.

Figure 1:
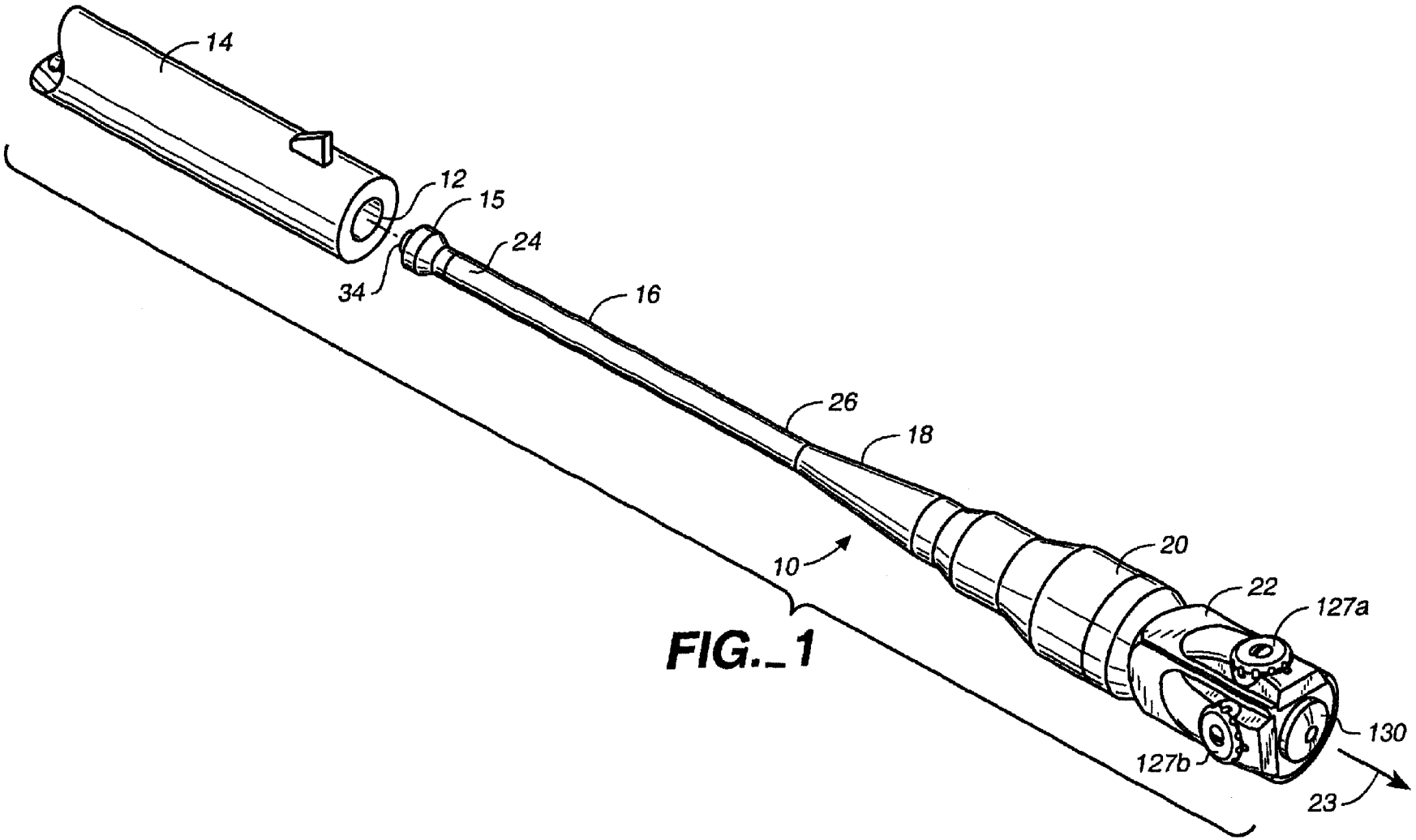
FIG. 1 is a perspective view of a laser precision bore sight assembly for insertion into the end of a gun barrel and for alignment of a laser beam along the axis of the gun barrel.
Figure 2:
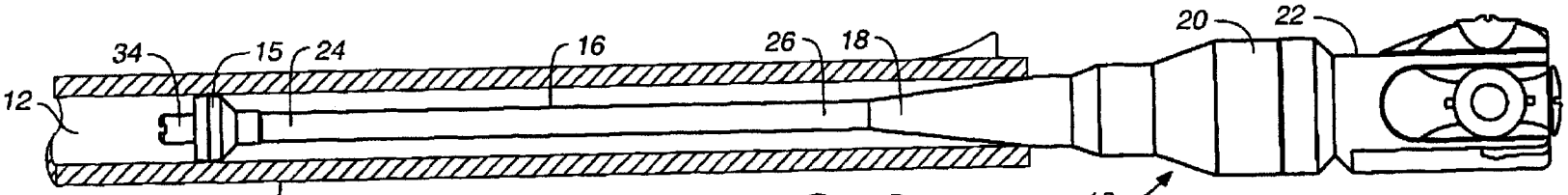
FIG. 2 is a partially sectional view of a section of a gun barrel with a laser precision bore sight assembly barrel according to the invention inserted therein.

FIGS. 1 and 2 illustrate a laser precision bore sight assembly 10 for insertion into the bore 12 of a gun barrel 14, of, for example, a rifle pistol, or shotgun for alignment of the gun sights. The laser precision bore sight assembly 10 includes a rotatable barrel insert 15 which is mounted on the proximate end of a bore shaft 16 and inserted into the gun barrel. At the distal end of the shaft 16 are coaxially attached a series of elements aligned along a longitudinal axis. These elements include an alignment cone 18, a coaxial battery/switch housing 20, and a coaxial laser housing 22. The function of the laser precision bore sight assembly 10 is to provide a laser beam 23 which is aligned with the longitudinal axis of the gun barrel.

The length of the bore shaft 16 is optionally long or short depending upon whether it is used with a rifle or a pistol. A proximate end 24 of the bore shaft 16 has the rotatable barrel insert 15 mounted thereto. The proximate end of the shaft 16 is inserted into the bore 12 of the gun barrel 14 to align the proximate end of the laser precision bore sight assembly 10 along the axis of the gun barrel. The distal end 26 of the bore shaft 16 is attached to the alignment cone by being press fit into a bore formed through a smaller end face of the alignment cone 18. The coaxial alignment cone 18 is a truncated cone which increases in diameter as it extends away from the smaller proximate end face to terminate in a larger distal end.

FIG. 2 illustrates that the conical surface of the coaxial alignment cone 18 is adapted to engage the inside edge of the bore 12 of the gun barrel in order to longitudinally position the distal end of the bore shaft 16 along the axis of the gun barrel. For each barrel diameter, somewhere along the alignment cone 18 is a circumference which matches the circumference of the inside edge of the gun barrel to concentrically align the distal end of the shaft with the longitudinal axis of the gun barrel.

Figure 3:
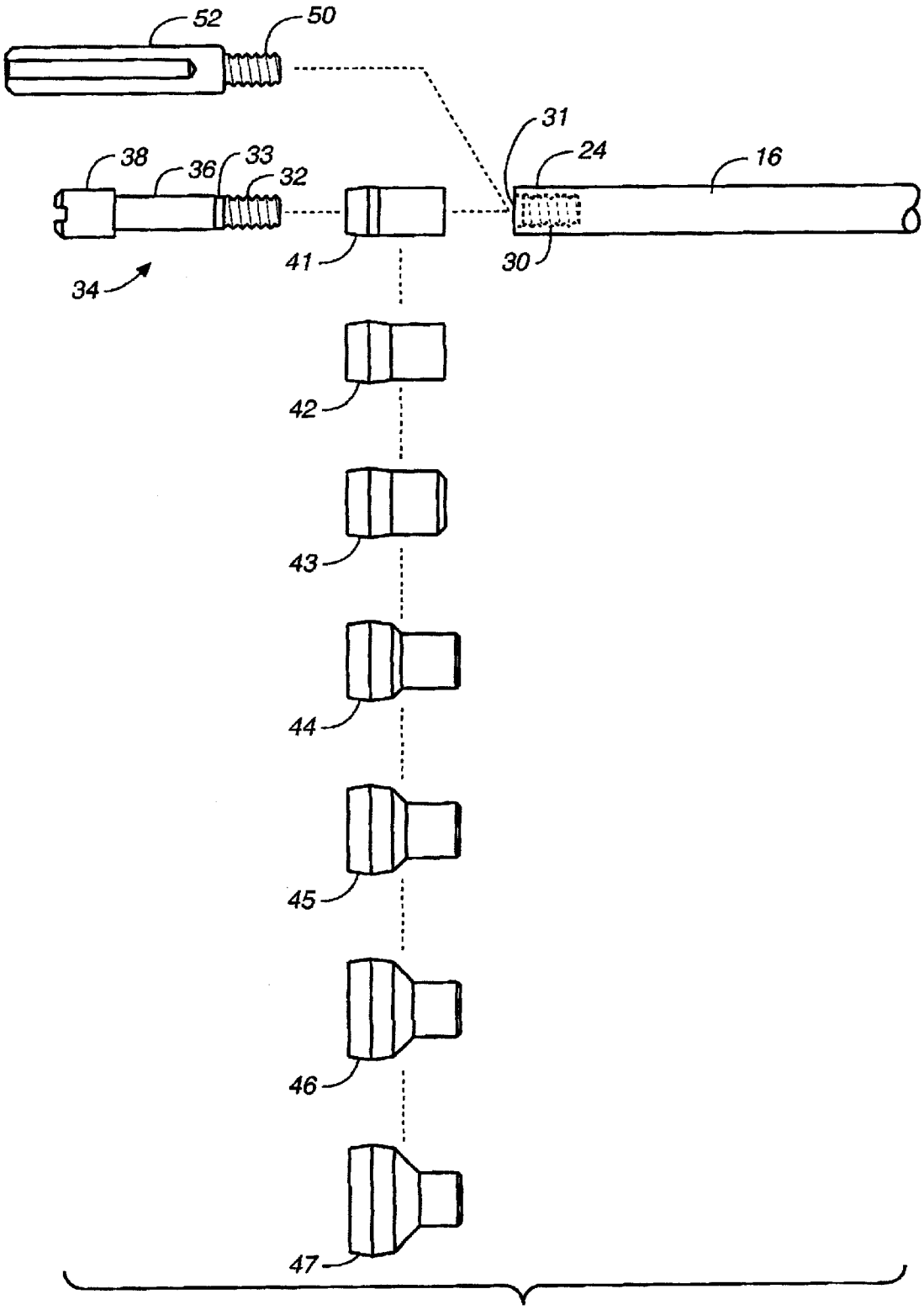
FIGS. 3 is an exploded view showing a bore sight assembly shaft, into the end of which is inserted a retainer screw on which is axially mounted for rotation a selected one of a number of illustrated barrel inserts, each corresponding to a particular gun-barrel caliber.

FIG. 3 illustrates that the proximate end 24 of the bore shaft 16 has an axial bore 30 which extends 0.060 inches into the end of the bore shaft. A smooth interior surface 31 is followed by a threaded countersink interior, which accommodates external threads 32 formed at one end of a coaxial barrel insert retainer shaft 34. The barrel insert retainer shaft 34 has a smooth external surface 33, which is approximately 0.04 inches in length and which is located adjacent to and inboard of the threads 32. When the external threads of the retainer shaft 34 are screwed into the internal threads in the end of the bore shaft 15, the surface 33 slip fits inside the surface 31, with the surfaces overlapping about approximately 0.040 inches to maintain axial alignment of the two shafts. The tolerances on the diameters of the overlapping surfaces 31, 33 are tightly held to create a very close slip fit therebetween. This helps to lock the retainer shaft 34 to the bore shaft 16 so that the retainer shaft 34 will not back out if the bore sight assembly 10 is counter rotated in the gun barrel.

The barrel insert retainer shaft 34 has an external cylindrical bearing surface 36. The diameter of the bearing surface 36 is smaller than the diameter of the bore shaft 16 to provide a step or shoulder therebetween. These shoulders hold the rotatable barrel insert 15 in position on the shaft 34.

FIG. 3 also illustrates a number of cylindrical barrel inserts 41–47 each of which is rotatably mountable on the smaller cylindrical bearing surface of the barrel insert retainer shaft 34 between the steps or shoulders formed by the larger shaft 16 and the larger end portion 38 of the barrel insert retainer shaft 34. The space between the shoulders allows the barrel insert to freely rotate with the rifling in a gun barrel to facilitate insertion of the barrel insert 15 into the gun barrel and to prevent the sharp edges of the barrel rifling from shaving off bits of the barrel insert. Each one of the cylindrical barrel inserts 41–47 corresponds to a particular gun-barrel caliber. Barrel insert 41 is used for a 0.22 caliber, 0.223 caliber, or 5.36 mm. gun barrel. Barrel insert 42 is used for a, which extends 0.270 caliber or 7 mm. gun barrel. Barrel insert 43 is used for a 0.30, 3006, 308, or 7.62 mm. gun barrel. Barrel insert 44 is used for a 0.38 caliber, 0.357 caliber, or 9 mm. gun barrel. Barrel insert 45 is used for a 0.40 caliber or 10 mm. gun barrel. Barrel insert 46 is used for a 0.44 caliber or 0.45 caliber gun barrel. Barrel insert 47 is used for a 0.50 caliber gun barrel.

The barrel inserts 41–47 are precision machined from a black acetal material. Acetal material, trademarked a Delrin®, is a crystalline thermoplastic polymer with a high melting point which provides a high modulus of elasticity combined with great strength, stiffness and resistance to abrasion. It provides dimensional stability for fabrication of close tolerance items. It has a low coefficient of friction, excellent machinability, good impact and abrasion resistance, and natural lubricity. The barrel inserts are machined from this flexible, resilient, tough, durable material. Acetal provides good slip characteristics over the steel material of a gun barrel without being deformed or marring the gun barrel or rifling. The barrel inserts are slightly oversized to accommodate worn, oversized gun barrels.

Instead of using the cylindrical barrel insert 41 for a 0.22, 0.223, or 5.56 mm. gun barrel, external threads 50 of an alternative metal spring barrel insert 52 are threaded into the internally threaded bore 30 of the shaft 16.

Figure 4A:
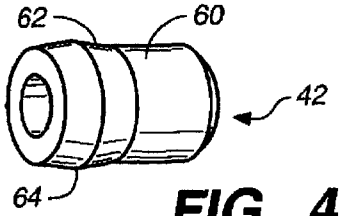
FIG. 4A is an enlarged perspective view of one type of typical barrel insert for use with a smaller caliber gun, such as a 0.270 caliber or 7 mm.
Figure 4B:
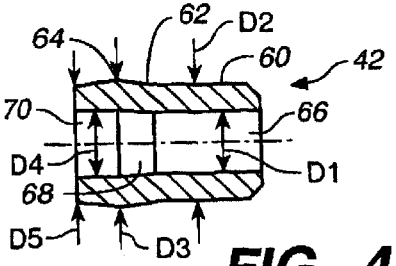
FIG. 4B is an enlarged sectional view of the barrel insert of FIG. 4A.
Figure 4C:
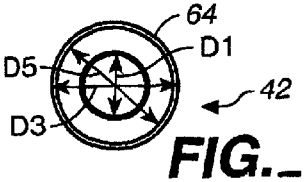
FIG. 4C is a cross sectional view of the barrel insert of FIG. 4A.

FIG. 4A, FIG. 4B and FIG. 4C illustrate in greater detail an exemplary embodiment of one type of typical barrel insert 42 for a smaller caliber gun barrel, such as a 0.270 caliber or 7 mm. gun barrel. The barrel insert 42 has two integral coaxial cylindrical symmetric sections, including a cylindrical base 60 and an attached radially resilient end section 62. The cylindrical base 60 rotatably mounts the barrel insert 42 to the end of the shaft 16 while the attached radially resilient end section 62 resiliently positions the axis of the end of the shaft 16 coaxially along the longitudinal axis of the gun barrel.

For this exemplary embodiment of a barrel insert, the cylindrical base 60 has a central bore 66 formed therein with an internal diameter D1 of 0.148+001−0.000 inches. To provide precision rotation of the barrel insert 42 around the retainer shaft 34, the interior wall defined by the central bore 66 in the section 60 engages the bearing surface 36 of the barrel insert retainer shaft 34, where the bearing surface 6 of the retainer shaft has a diameter of 0.148+/−0.0005 inches. The smaller external diameter D2 of the base section 60 is 0.246 inches to accommodate the 0.270 inch diameter of the gun barrel bore.

The external diameter of the radially resilient end section 62 increases from the 0.246 inches of the external diameter D2 of the base 60 to a peaked cylindrical ridge area 64 which has a maximum diameter D3 of 0.274 inches. The external diameter of the radially resilient end section 62 then tapers back down to a diameter D5, which is the same as the smaller diameter D2 of the base 60. The outer end of the resilient end section 62 has an internal bore 70 formed approximately half way through with a diameter D4 of 0.160 inches. The inner portion of the end section 64 has an internal bore formed therein which decreases in diameter from diameter D4 to diameter D1.

When the barrel insert 42 is positioned in the gun barrel for rotation about the longitudinal axis of the barrel insert retainer shaft 16, the interior walls of the main cylindrical section 60 of the barrel insert 42 snugly engage the cylindrical bearing surface 36 of the barrel insert retainer shaft 34 to provide precise rotation of the barrel insert 42. Note that the interior surface of the bores in the end section 64 do not engage the bearing surface 36 of the barrel insert retainer shaft 16.

When the barrel insert 42 is inserted into the 0.270 diameter gun barrel, the external surface of peaked cylindrical ridge area 64 with the maximum diameter D3 of 0.274 inches contacts the wall of the gun barrel and is pushed radially inwardly to conform to the smaller 0.270 diameter of the gun barrel. In this manner, the external contact area of the peaked cylindrical ridge area 64 of the barrel insert 42 snugly engages the wall of the gun barrel to precisely coaxially position the one end 24 of the shaft 16 within the gun barrel 14 along the longitudinal axis of the gun barrel.

The smooth cylindrical surface of the peaked cylindrical ridge area 64 of the barrel insert 42 provides continuous contact with the inner wall of the gun barrel in spite of the rifling grooves formed in the gun barrel. The tough black acetal material of the barrel insert 42 does not damage the interior surface or the rifling of the gun barrel.

Figure 5A:
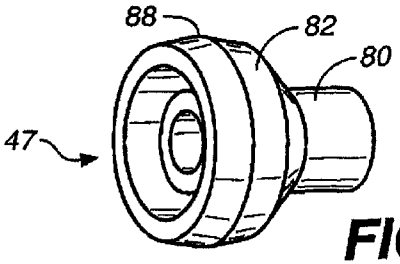
FIG. 5A is an enlarged perspective view of another type of typical barrel insert for use with a larger caliber gun barrel, such as a 0.50 caliber.
Figure 5B:
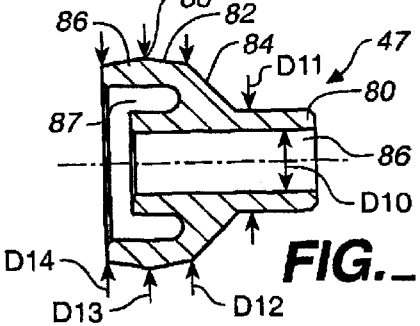
FIG. 5B is an enlarged sectional view of the barrel insert of FIG. 5A.
Figure 5C:
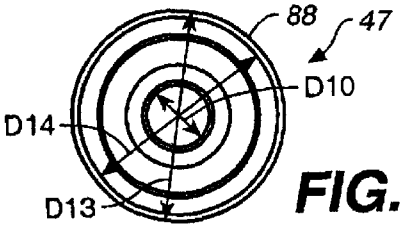
FIG. 5C is a cross sectional view of the barrel insert of FIG. 5A.

FIG. 5A, FIG. 5B and FIG. 5C illustrate in greater detail another embodiment of a barrel insert for a larger caliber gun, i.e., the barrel insert 47 for a 0.50 caliber gun barrel. The barrel insert 47 includes two cylindrically symmetric, coaxial, and partially concentric sections including a main cylindrical section 80 with smaller internal and external diameters and a radially resilient cantilevered section 82 with larger internal and external diameters. The main cylindrical section 80 has a central bore 86 formed there through with an internal diameter D10 of 0.148+001−0.000 inches to provide precision rotation of the barrel insert 47 around the retainer shaft 34. The interior wall defined by the central bore 86 in the section 80 engages the bearing surface 36 of the barrel insert retainer shaft 34, where the bearing surface 34 of the retainer shaft has a diameter of 0.148+/−0.005 inches. The external diameter D11 of the main cylindrical section 80 is 0.246 inches to clear the wall of a 0.500 caliber gun barrel.

The radially resilient cantilevered section 82 is formed integral with the main cylindrical section 80 and includes an integral radially outwardly extending support flange section 84 from which longitudinally extends an integral cantilevered resilient ring 86. The support flange 84 has an outside diameter which steadily increases from the external diameter D11 to a diameter D12 which is 0.470 inches. The integral cantilevered resilient ring 86 increases in diameter to a peaked cylindrical ridge area 88 which has a maximum diameter D13 of 0.502 inches. The external diameter of the integral cantilevered resilient ring 86 then tapers back down to a diameter D14, which is the same as D12. The integral cantilevered resilient ring 86 is spaced apart from the main cylindrical section 80 by having a ring-shaped open space 87 formed beneath it to allow the cantilevered resilient ring 82 to flex inwardly.

When the barrel insert 47 is guided into a 0.500 diameter gun barrel, the external surface of peaked cylindrical ridge area 88 with the maximum diameter D13 of 0.502 inches contacts the wall of the gun barrel and is pushed radially inwardly to conform to the smaller 0.500 diameter of the gun barrel. In this manner the external contact area of the peaked cylindrical ridge area 88 of the barrel insert 47 snugly engages the wall of the gun barrel to precisely position the proximate end 24 of the shaft 16 within the gun barrel 14 along the longitudinal axis of the gun barrel. The smooth cylindrical shape of the barrel insert peaked cylindrical ridge area 88 provides smooth contact with the inner wall of the gun barrel in spite of the rifling grooves formed in the gun barrel. The tough material of the barrel insert 47 does not damage the interior surface or the rifling of the gun barrel.

Figure 6A:
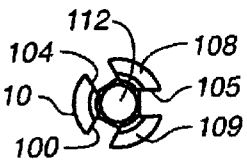
FIG. 6A is an end view of an alternative metal spring barrel insert for a small caliber gun.
Figure 6B:
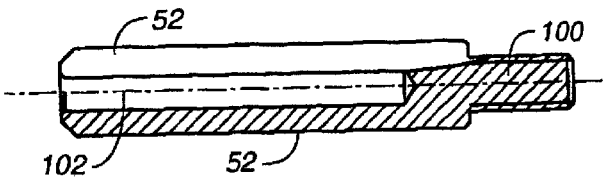
FIG. 6B is a partially sectional view of the alternative metal spring barrel insert FIG. 6A.

FIG. 6A and FIG. 6B illustrate an alternative metal spring barrel insert 52 for a gun having a small caliber such as a 0.22, 0.223, or 5.56 mm caliber. The spring barrel insert 52 is formed of a rod-shaped body having a diameter of 0.210 inches. External threads 100 are formed at one end of the spring barrel insert 52 for engagement with the internal threads of the bore 30 formed in the one end 24 of the shaft 16. A longitudinal bore 102 is formed through the other end of the spring barrel insert 52 and three evenly spaced longitudinal slots 104, 105, 106 are formed along part of the length of the spring barrel insert to provide flexible longitudinally extending prongs 108, 109, 110. A 0.093 chrome-plated ball 112 is pressed between the prongs to expand the prongs to fit within the barrel of a 0.22, 0.223, or 5.56 mm caliber gun.

Figure 7:
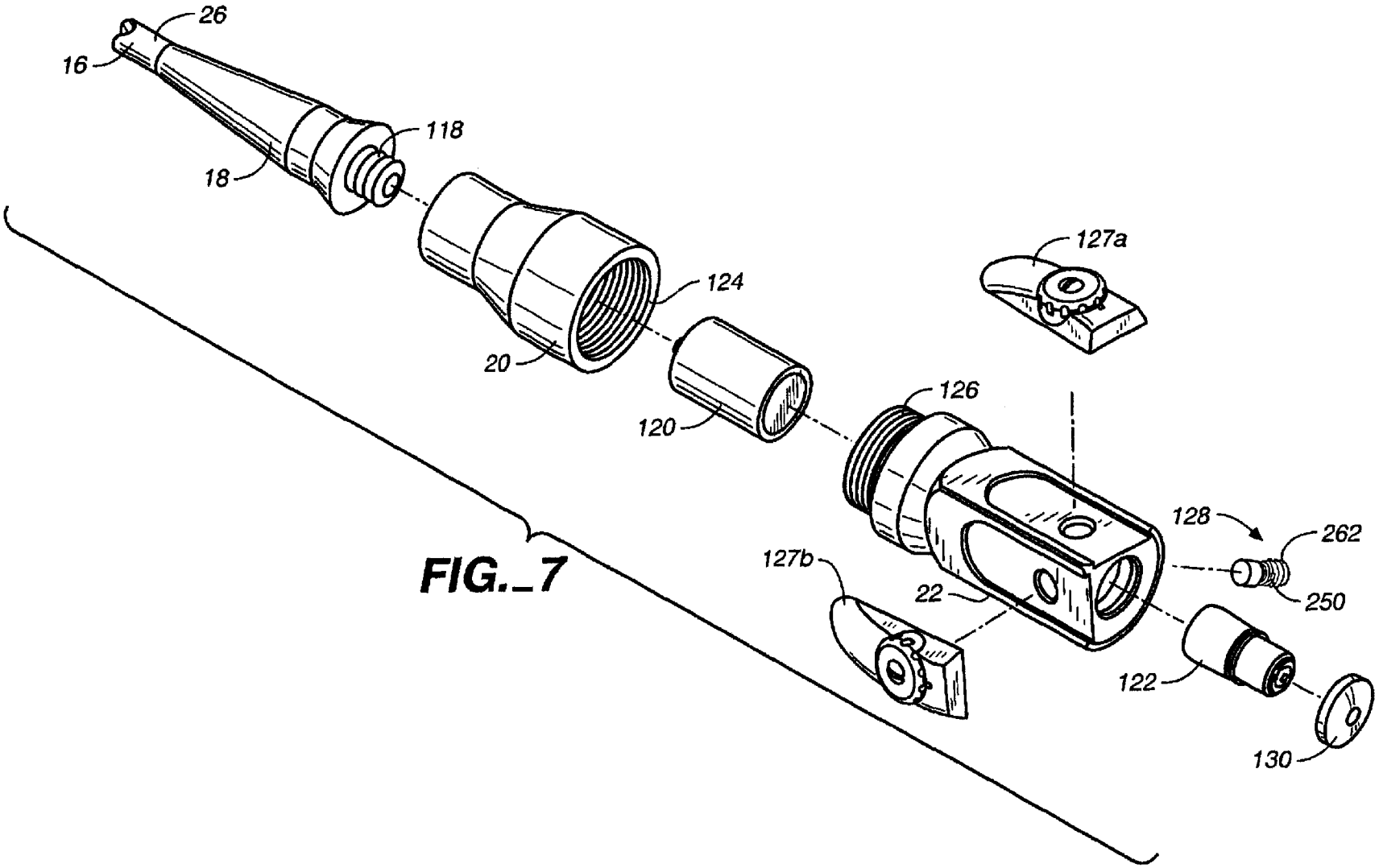
FIG. 7 is an exploded, perspective view of a laser precision bore sight assembly according to the invention.

FIG. 7 illustrates the various components assembled on the distal end 26 of the shaft 16 of the laser precision bore sight assembly 10. A bore in the narrow end of the coaxial alignment cone 18 is press fit onto the end of the shaft 16, where the coaxial alignment cone 18 provides for coaxial alignment of the distal end of the shaft 16 with the distal end of various different caliber gun barrels.

The other larger, distal end of the coaxial cone 18 has an externally threaded stud 118 formed thereon which engages corresponding internal screw threads formed in the proximate end of the battery/switch housing 20. A battery 120 is contained in a central cavity formed between the distal end of the battery/switch housing 20 and the proximate end of the coaxial laser housing 22. Internal screw threads 124 in the battery/switch housing 20 engage corresponding external threads 126 formed in the proximate end of the laser housing 22. Rotation of the laser housing 22 with respect to the battery/switch housing 20 causes a positive terminal of the battery 120 to activate a switch in the battery/switch housing 20.

The laser housing 22 contains a laser subassembly 122 having a laser source and collimating lens to provide a collimating laser beam which is coaxially aligned along the axis of the gun barrel. Adjustments to the alignment of the laser beam are made with a 3-point adjustment system which includes a pair of windage/elevation adjustment assemblies 127*a,* 127*b* and one fixed adjustment screw mechanism 128. A front cap and lens assembly 130 fixed to the end of the laser housing covers the laser subassembly 122.

Figure 8:
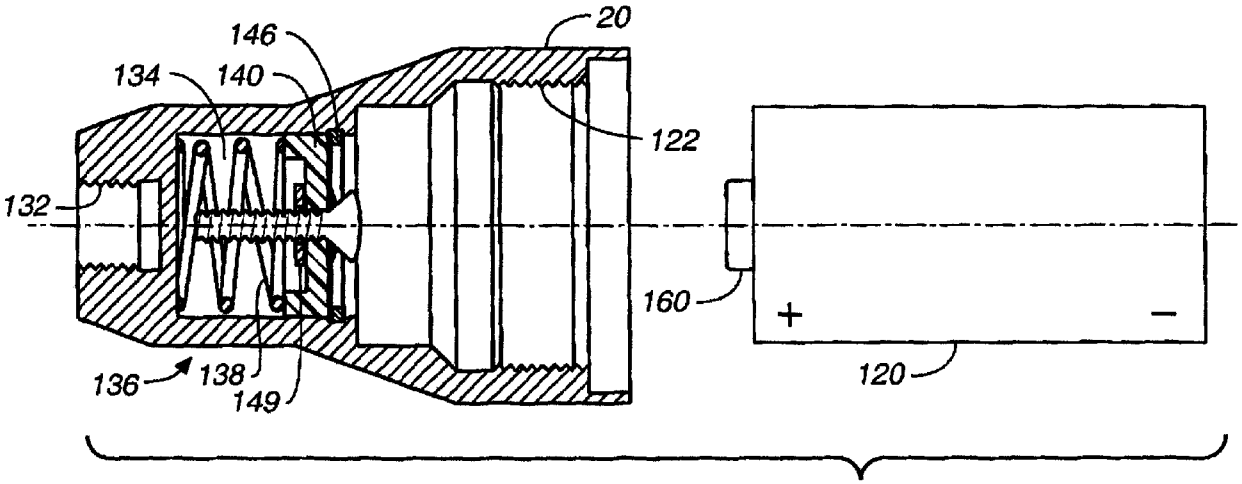
FIG. 8 is a sectional view showing a battery/switch housing with a battery switch assembled therein which is actuated by rotating the battery switch housing with respect to the laser housing so as push a battery terminal against one end of a contact pin so that the other end of the contact pin contacts the housing to complete the battery circuit to the laser source.
Figure 9:
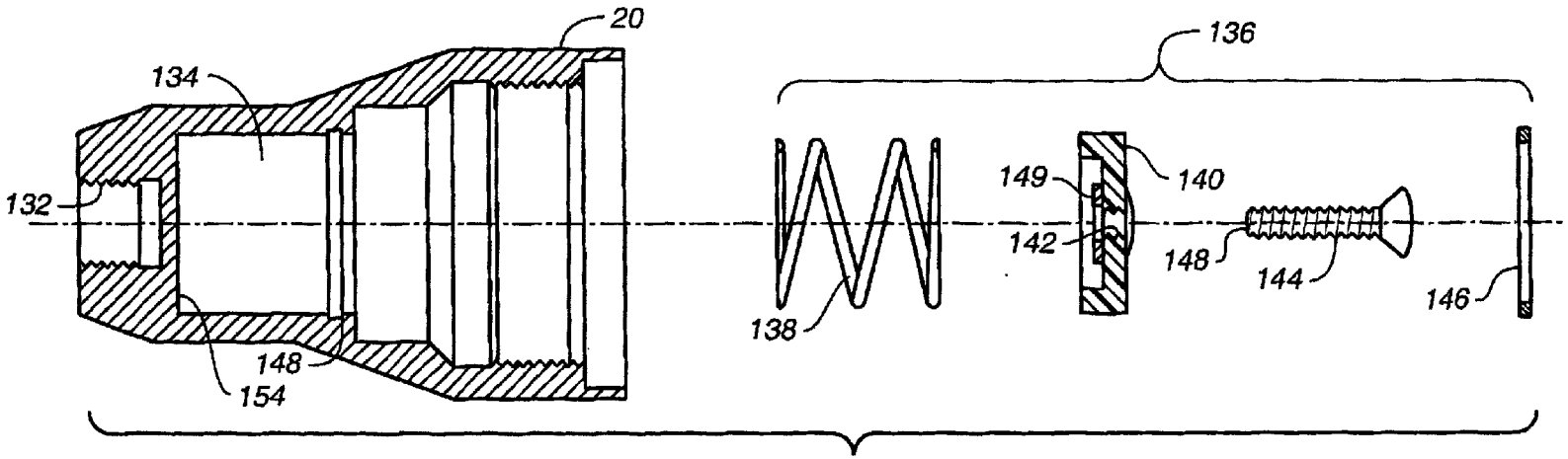
FIG. 9 is an exploded view showing the battery/switch housing and the battery switch components.

FIGS. 8 and 9 illustrate in more detail the battery/switch housing 20 and its contents. The battery/switch housing 20 includes an internally threaded axial bore 132 formed at one end for engagement with the externally threaded stud 118 on the distal end of the coaxial cone 18 shown in FIG. 7. A preferred embodiment has the battery/switch housing 20 and the laser housing 22 made of aluminum. The exterior surfaces of the aluminum battery/switch housing 20 and the laser housing 22 are anodized. All of the threaded surfaces and the interior surfaces are not anodized to facilitate electrical conduction. The distal end of the battery/switch housing 20 includes an innermost cylindrical cavity 134 for containing the components of a switch assembly 136. The switch assembly 136 includes a compression spring 138 which is contained in the cavity 134 and which has flattened ends. A cup-shaped fiber washer 140 with a counter bore is contained in the cavity 134 and has a center bore 142 formed therethrough for receiving the threads of a contact pin, 144 such as a flat-head brass screw or a smooth pin. The flat-head brass screw 144 has a conical head 146 at one end and an end contact surface 148 at the other end. Solder covers the top surface of the conical head 146 the contact pin is fixed to the fiber washer 14 by being soldered to a nickle-plated washer 149 on the side of the fiber washer 140 opposite the head of the pin 144.

The compression spring 138 is contained within the cavity 134 and pushes against the inside peripheral surface of the fiber washer 140. The fiber washer 140 is held inside the cavity 134 with a C-ring retainer which is locked into a circumferential groove 148 formed in the wall of the cylindrical cavity 134. When the compression spring 138 is extended so that the outside edge of the fiber washer 140 contacts the inside surface of the C-ring retainer, the far end 148 of the flat-head screw 144 does not contact the interior end wall 154 of the cavity 134.

The external threads 126 of the laser housing 22 engage the internal threads 124 of the battery/switch housing 20. Rotation of the screw threads of the laser housing 22 into the screw threads of the battery/switch housing 20 causes the positive terminal 160 of the battery 120 to push against the top 146 of the screw 144 to compress the compression spring 138 such that the end surface 148 of the screw 144 contacts the aluminum surface of the interior end wall 154. This connects the positive terminal 160 of the battery 120 to the aluminum housing 20. Rotation of the battery and switch housing 20 in the opposite direction with respect to the laser housing 22 causes the compression spring to extend such that the far end 148 of the flat-head screw 144 or contact pin does not contact the interior end wall 154 of the cavity 134. This breaks the connection of the positive terminal 160 of the battery 120 to the aluminum housing 20.

Figure 10:
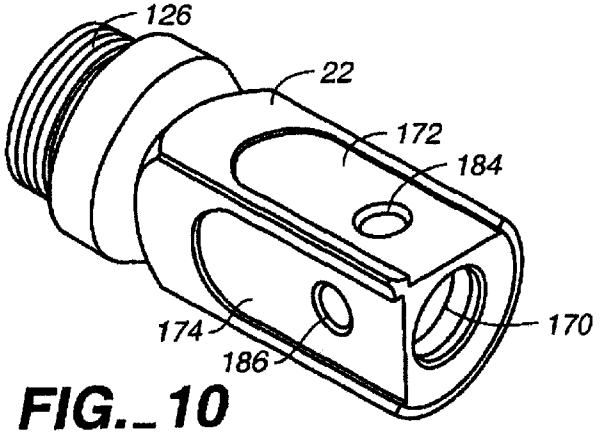
FIG. 10 is a perspective view of a laser housing.
Figure 11:
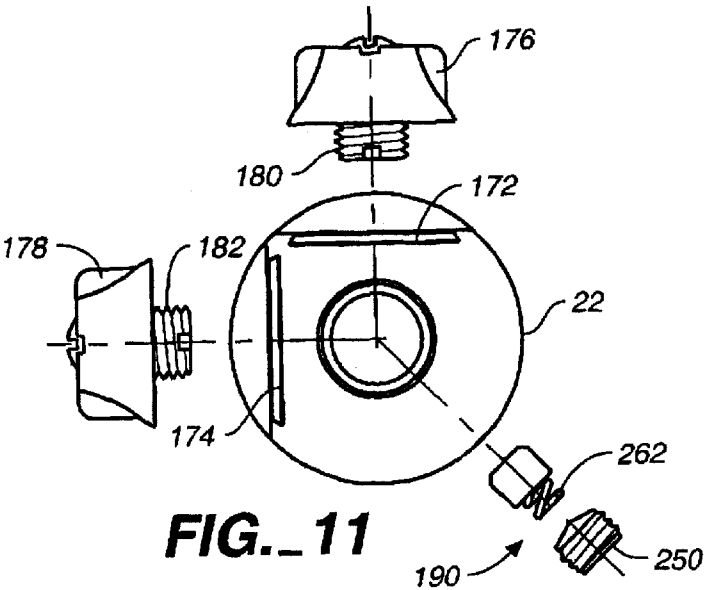
FIG. 11 is an exploded end view showing a laser housing along with a fixed set screw and two adjustable windage/elevation assemblies.

FIGS. 10 and 11 illustrate the body of the laser housing 22. The distal end of the laser housing 22 has a longitudinal central bore 170 formed therein for receiving the cylindrical body of the laser subassembly 122 shown in FIG. 7. As described herein below, alignment of the laser beam in the laser subassembly 122 is provided using a three-point alignment mechanism which is mounted to the laser housing 22. The external surface of the distal end of the laser housing 22 has two orthogonal external flat-surfaced dovetailed keyways 172, 174 formed thereupon for receiving corresponding dovetailed bases of two windage/elevation adjustment assemblies 176, 178. The windage/elevation adjustment assemblies 176, 178 are fixed to the laser housing with bonnet screw threads 180, 182. Each bonnet screw thread 180, 182 screw passes through a respective threaded aperture 184, 186 in the laser housing 22 such that the ends of respective adjustment screws (not shown) for each windage/elevation adjustment assembly contact the laser subassembly 122 for alignment of the laser beam. One adjustment screw is aligned for movement in a first direction perpendicular to the longitudinal axis of the shaft. A second adjustment screw is aligned for movement in a second direction perpendicular to the longitudinal axis of the shaft and also orthogonal to the first direction of movement of the one adjustment screw.

FIG. 11 also illustrates a third element of the three-point alignment mechanism for the optical assembly which is a spring-loaded fixed screw assembly 190. The spring-loaded fixed screw assembly 190 is screwed into position in a threaded aperture in the laser housing 22 opposite the adjustment screws and at equal obtuse angles with the directions of the adjustment screws to bias the laser subassembly 122 against the ends of the first and the second adjustment screws.

Figure 12:
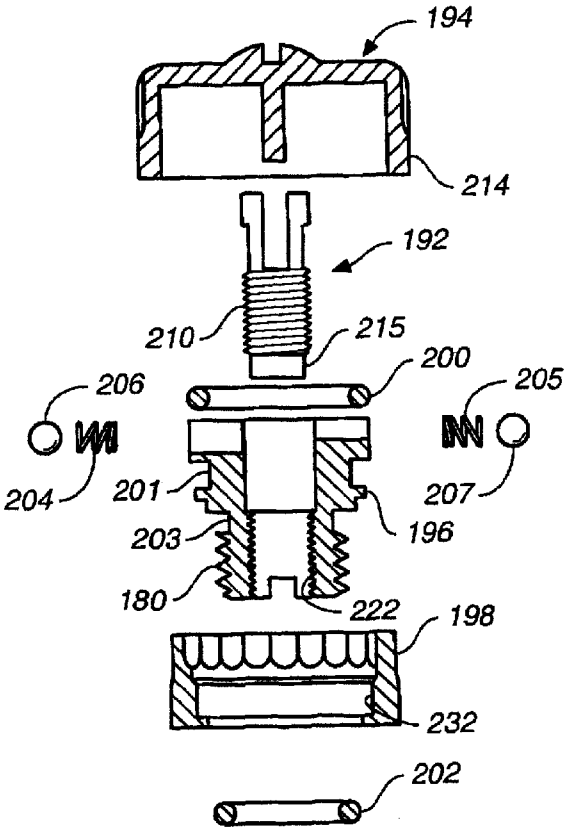
FIG. 12 is an exploded, partially sectional view of an adjustable windage/elevation assembly.

FIG. 12 illustrates a typical windage/elevation adjustment assembly, which includes an adjustment screw 192, a cap 194, a bonnet 196, and a fine adjustment retainer ring 198. Waterproofing of the windage 1 elevation adjustment assembly is accomplished with a first O-ring 200 which engages a circumferential slot 201 formed in the bonnet 196 and a second O-ring 202 which engages another circumferential slot 203 formed in the bonnet 196. Each one of a pair of springs 204, 205 outwardly biases a respective ball of a pair of 1.5 mm. stainless steel balls 206, 207.

Figure 13:
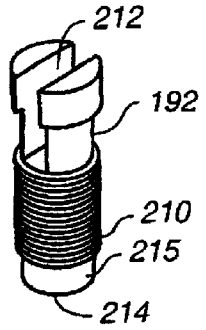
FIG. 13 is a perspective view of an adjustment screw for the windage/elevation assembly of FIG. 12.
Figure 14:
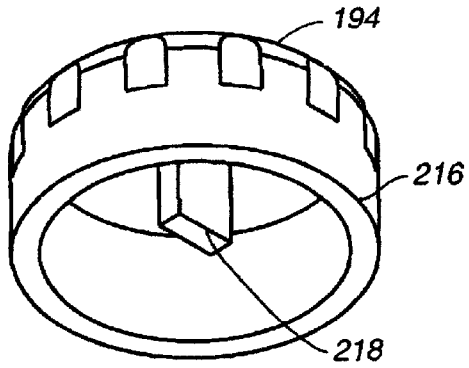
FIG. 14 is a perspective view of a cap for the windage/elevation assembly of FIG. 12.

FIG. 13 shows that the adjustment screw 192 has external threads 210 formed on its midsection with a slot 212 through its upper end. The adjustment screw 192 includes an end contact surface 215 at its bottom end for contact with the laser subassembly 122. The external threads 210 of the adjustment screw 192 do not extend to the bottom end of the adjustment screw, which provides an unthreaded, smooth side surface 215 at the lower end of the adjustment screw 192. FIG. 14 shows that the cap 194 has a cupped body 216 with a centrally located depending rectangular tang 218 which engages the slot 212 in the upper end of the adjustment screw.

Figure 15A:
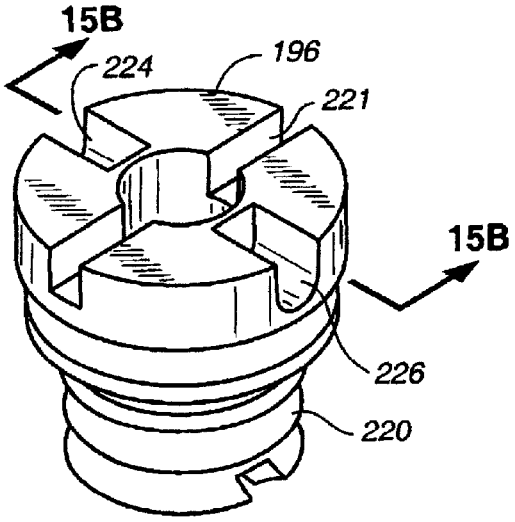
FIG. 15A is a perspective view of a bonnet for the windage/elevation assembly of FIG. 12.
Figure 15B:
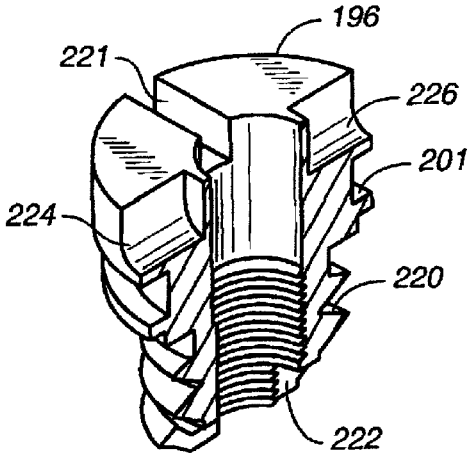
FIG. 15B is a sectional, perspective view of the bonnet, taken along section line 15B—15B of FIG. 15A, for the windage/elevation adjustment assembly of FIG. 15A.

FIGS. 12, 15A, and 15B show the bonnet 196 with the external threads 800 which are formed on its lower end and which are then threaded into one of the threaded apertures 184, 186 of the laser housing 22 to anchor the windage/elevation adjustment assemblies 176, 178 in place. The O-ring 202 in slot 203 provides a water seal between the bonnet and the laser housing. The external threads 210 of the adjustment screw 192 engage internal threads 222 in the bonnet 196 for relative movement of the contact surface 215 at the end of the adjustment screw 192 against the laser subassembly 122. A horizontal screwdriver slot 221 across the top of the bonnet 196 is used to screw the bonnet 196 to the laser housing 22. The bonnet has a pair of opposing horizontal radial slots 224, 226 formed near its top end for containing one of the springs 204, 205, which outwardly bias the steel balls 205,206.

Figure 16:
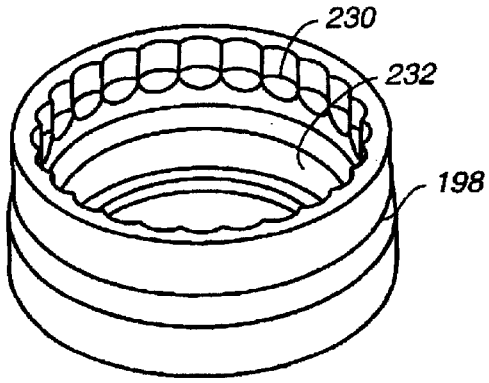
FIG. 16 is a perspective view of a retainer ring which provides fine adjustment steps for the windage/elevation adjustment assembly of FIG. 12.

FIGS. 12 and 16 show the fine adjustment retainer ring 198 with a number of pairs of opposing recesses, typically shown as 230, formed near the top of its inside surface. The fine adjustment retainer ring 198 fits around the bonnet 196. After assembly of the windage/elevation adjustment assembly, an external cylindrical surface of the retainer ring 198 is press fit inside an inner cylindrical surface of the cupped body 216 of the cap 194. Each of the springs 204, 205 is retained in one of the slots 224, 226 and biases one of the pair of steel balls 206, 207 into engagement with one of the recesses 230 to provide detented or indexed fine adjustment steps for the adjustment screw 192 as the cap 194 is rotated. A water seal protecting the threads of the screw 192 against moisture is provided with the O-ring 200 which is in the slot 201 of the bonnet and which engages an inside circumferential surface 232 in the retainer ring 198.

Figure 17:
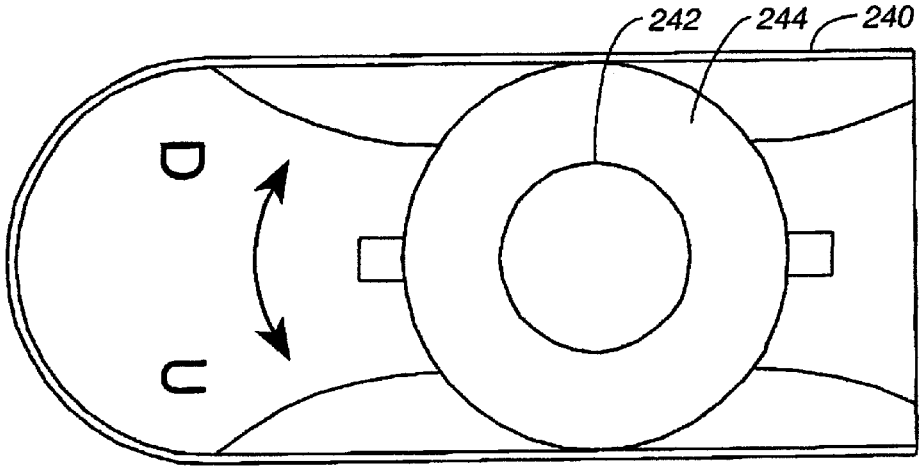
FIG. 17 is a plan view of a base for the windage/elevation assembly of FIG. 12.

FIG. 17 illustrates a base 240 for a windage/elevation adjustment assembly The side edges and the rounded front edge of the base are dovetailed and are received in one of the dovetailed keyways 172, 174 formed on the laser housing 22. A through hole 242 accommodates a windage/elevation adjustment assembly and a recessed ring 244 accommodates the cap 194.

Figure 18:
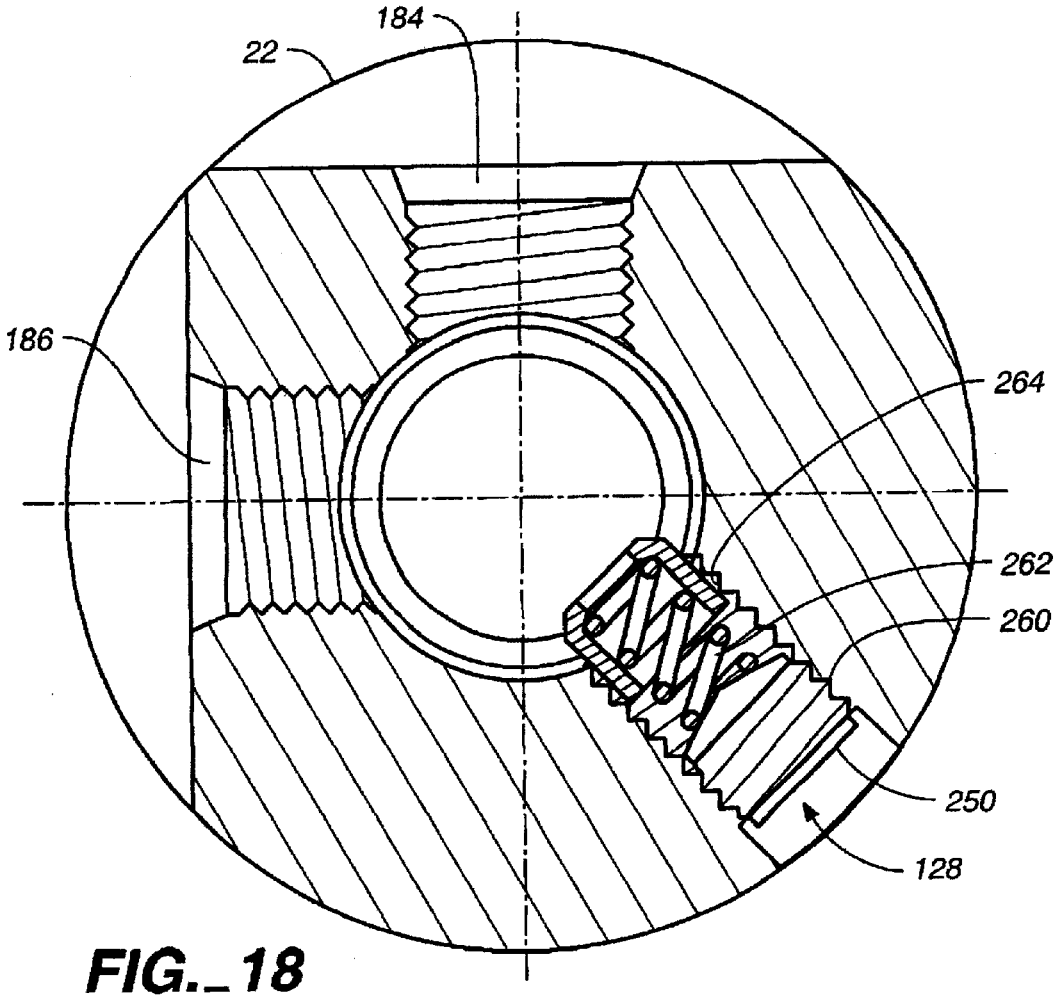
FIG. 18 is a cross sectional view of the laser housing showing a fixed adjustment assembly, which includes a bushing, a spring, and a set screw for biasing a laser module against a pair of adjustable windage/elevation assemblies.

FIG. 18 illustrates the spring-loaded fixed screw assembly 190 which includes a set screw 250 which is screwed into a threaded aperture 260 in the laser housing 22. A spring 262 is located between the inner end of the screw 250 and a cup-shaped cap, or bushing, 264 which contacts the surface of the laser to bias the laser subassembly 122 against the first and the second adjustment screws 180, 182.

Figure 19:
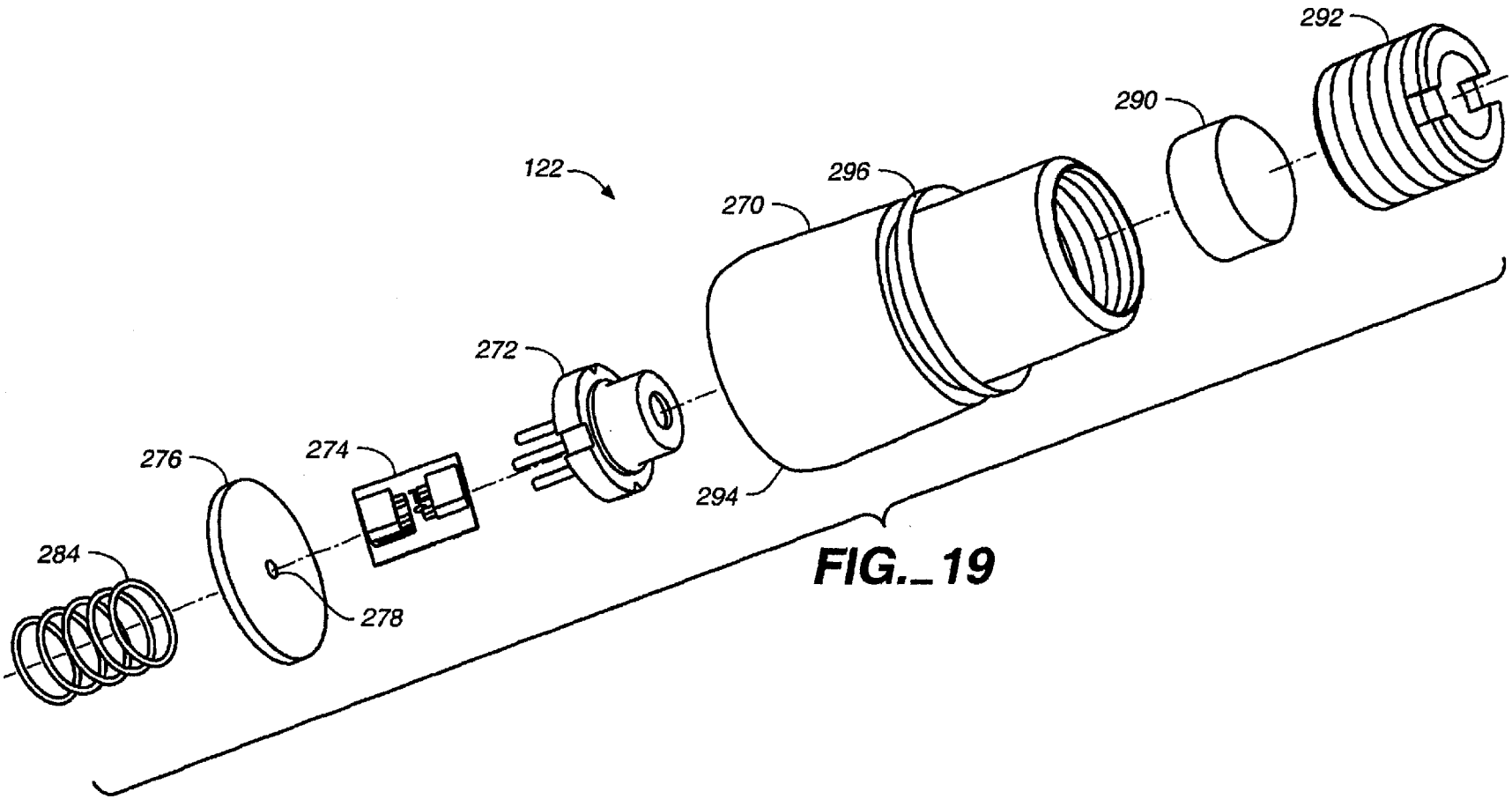
FIG. 19 is an exploded, perspective view of a laser module subassembly.
Figure 20:
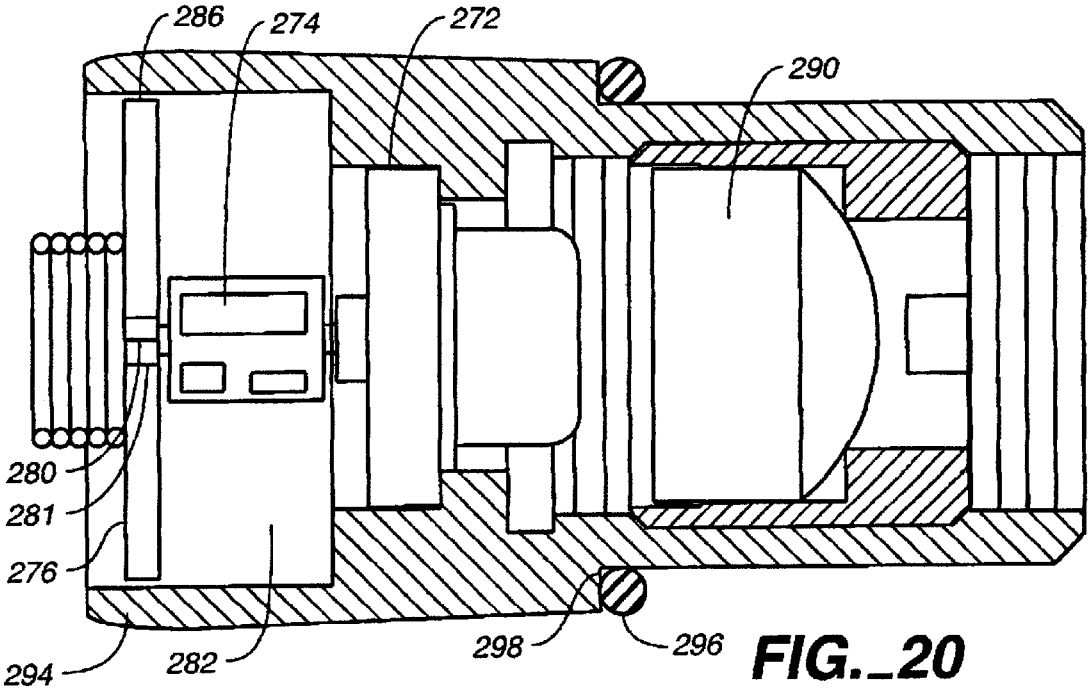
FIG. 20 is an assembled sectional view of the laser module subassembly of FIG. 19.

FIGS. 19 and 20 illustrate the components of the laser subassembly 122, which include a hollow pear-shaped laser heatsink 270 which contains a laser diode assembly 272 and an associated circuit board 274 that is soldered to three pins on the laser diode assembly. A disk module 276 is a laminated circuit board with a gold-plated copper layer and apertures which are typically formed therethrough to allow passage of wires 280, 281. The space 284 connects to the negative terminal of the battery. The components of the laser subassembly 272 are fixed in position by encapsulation with a block 282 of an epoxy material. The distal end of the laser heatsink 270 contain a lens 290 attached to an end plug 292, which is adjusted to collimate a laser beam from the laser diode assembly 272.

A rounded proximate end 294 of the pear-shaped laser heatsink 270 has the largest diameter and is dimensioned to provide a friction fit with a corresponding inner surface of the laser housing 22. An O-ring 296 is located adjacent to a step 298 at the midsection of the pear-shaped laser heatsink 270.

Figure 21:
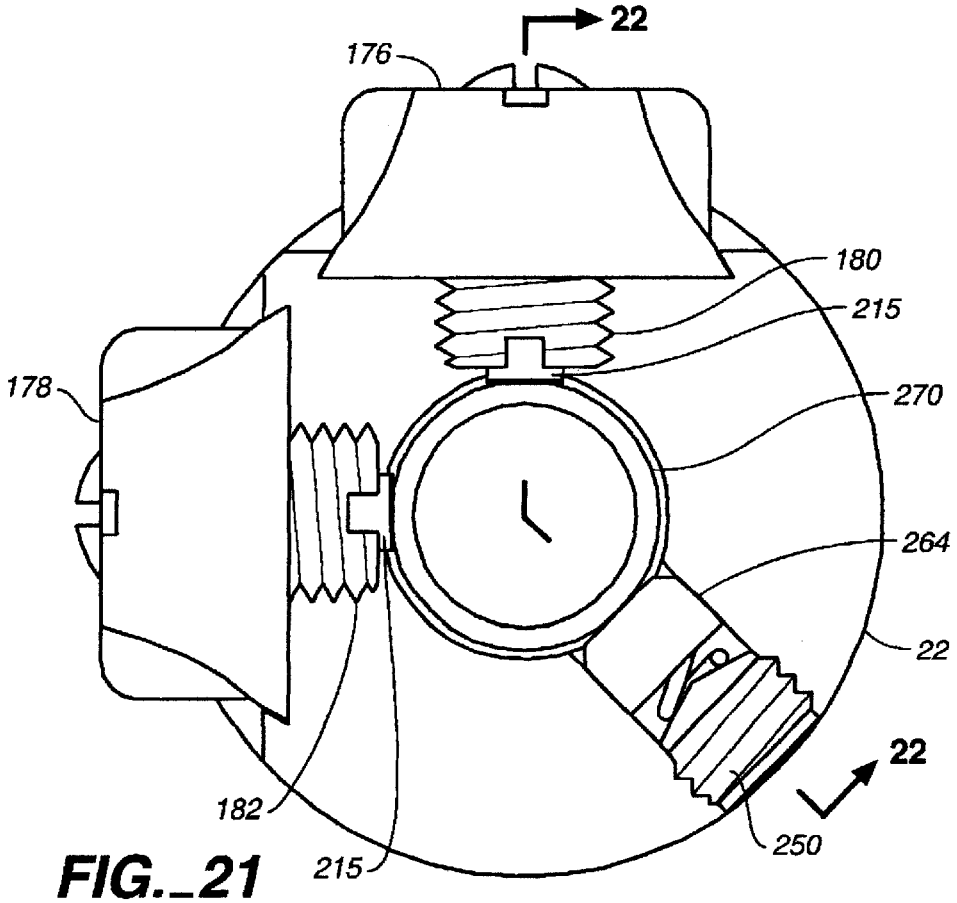
FIG. 21 is a sectional view of laser housing with a showing two windage/elevation adjustment assemblies and a spring loaded bushing for alignment of a laser beam from a laser housing assembly.
Figure 22:
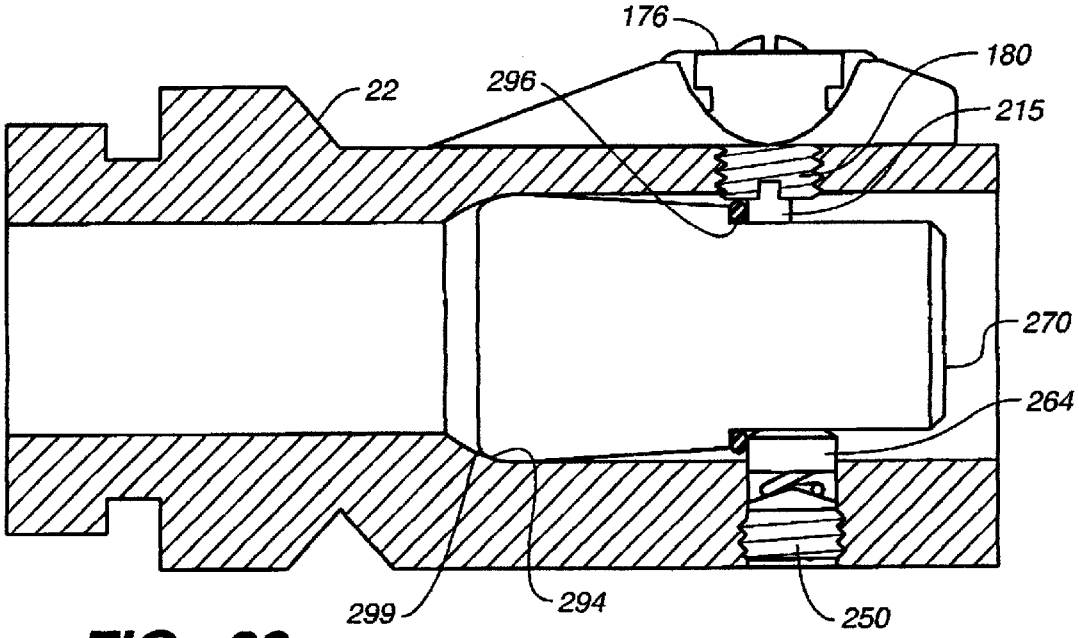
FIG. 22 is a sectional view, taken along section line 22—22 of FIG. 21, of a laser housing containing a laser assembly, having a windage/elevation adjustment assembly and a spring loaded bushing.

FIGS. 21 and 22 illustrate a structural arrangement which provides for three-point adjustment of the laser beam from the laser source in the pear-shaped laser heatsink 270. The inner surface 299 of the laser housing 22 is shaped to provide a close friction fit with the rounded end 294 of the pear-shaped laser housing 294. This structural arrangement allows precise pivotal movement of the distal end of the laser module 122 as illustrated in FIG. 11 with the three-point alignment produced by the two windage/elevation adjustment assemblies 176, 178 and the spring-loaded fixed screw assembly 190. This allows precise alignment of and orients the laser beam along the axis of the precision bore sight assembly 10 and along the bore of a gun barrel. FIG. 22 shows that the unthreaded, smooth side surfaces 215 at the lower end of the adjustment screws 192 contacts the forward side of the O-ring 296 and compresses the O-ring 10 to 20 per cent to provide friction loading on the ends of the adjustment screws.

Figure 23:
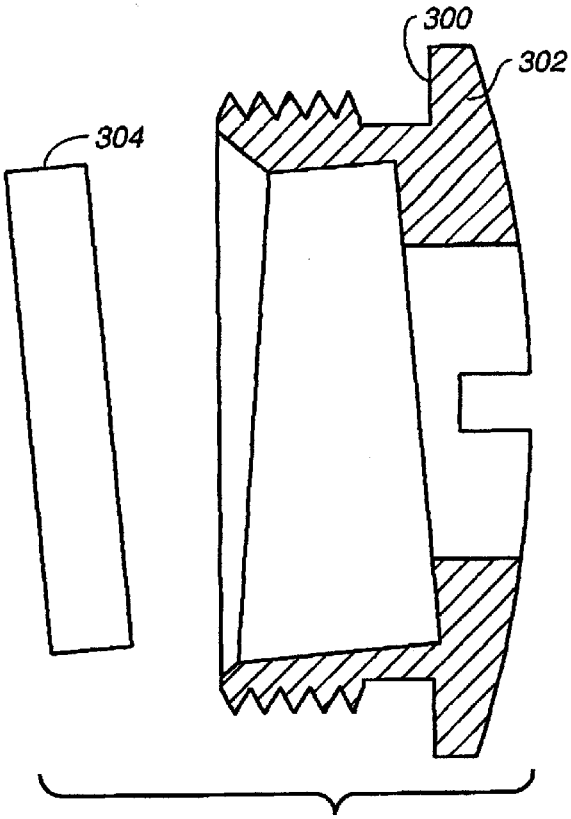
FIG. 23 is an exploded, partially sectional view of a front cap and lens.
Figure 24:
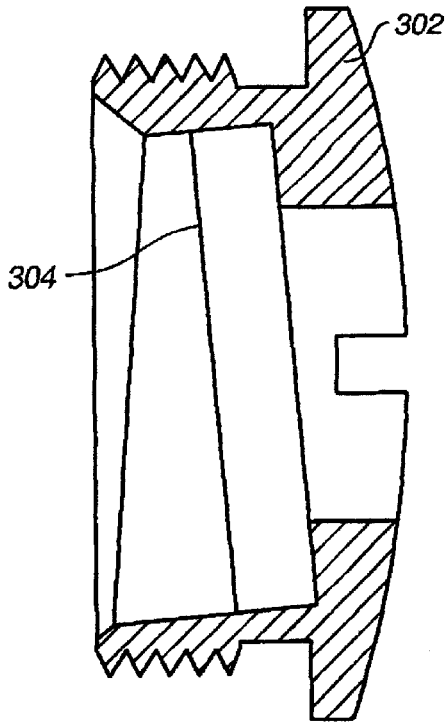
FIG. 24 is a sectional view of an assembled front cap and lens.

FIGS. 23 and 24 illustrate an optional lens assembly 300 which includes an end cap 302 and a lens 304 is an exploded, partially sectional view of a front cap and lens. FIG. 22 is a sectional view of an assembled front cap and lens assembly.

Another embodiment of a different coaxial laser housing is provided where the windage and elevation settings for a bore sight assembly are initially made with set screws which are then sealed with a locking adhesive. This allows a bore sight assembly to be prealigned at, for example, a factory or a service location. A modified coaxial laser housing is provided which is similar to the housing 22, but which is smaller in diameter and does not have dovetailed sections for mounting manual adjustment assemblies. Bores for the windage and elevation set screws are provided which correspond to the orthongonally aligned bores 184, 186 but which are smaller in size to directly receive the fixed adjustment screws without a bonnet. A plunger biasing assembly, similar to the plunger assembly 190 is also used. The fixed adjustment screws and the plunger assembly are locked in position with a suitable locking material.

Note that the bore sight assembly according to the invention is useful for sight alignment of optical scopes, mechanical firearm sights, and laser sighting devices. The bore sight assembly according to the invention is also useful for simulating alignment and firing of a weapon use in a firearms training system.

The foregoing descriptions of specific embodiments of the present invention have been presented for purposes of illustration and description. They are not intended to be exhaustive or to limit the invention to the precise forms disclosed, and obviously many modifications and variations are possible in light of the above teachings. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A laser precision bore sight assembly for bore sight alignment of a laser beam along the longitudinal axis of a gun barrel, comprising:

an elongated bore shaft having a longitudinal axis and adapted to having a proximate end thereof inserted into the bore of the gun barrel;

a compressible barrel-shaped insert which is rotatably mounted to the proximate end of the bore shaft and which has a continuous outer surface which is adapted to be inserted in the gun barrel to resiliently engage the inside wall of the gun barrel such that a longitudinal axis of approximate end of the bore shaft is coaxially aligned with the longitudinal axis of the gun barrel;

at the distal end of the bore shaft is provided an alignment cone which has an external distally increasing conical surface which is adapted to engage a distal inner edge of the gun barrel in order to coaxially align a distal end of the bore shaft for rotation about the longitudinal axis of the gun barrel;

a battery/switch housing which is coaxially mounted adjacent to the alignment cone and which contains an electrical switch assemble;

a laser housing assembly which is coaxially mounted to the battery/switch housing and which contains a laser subassembly having a laser source which provides a laser beam in a direction coaxial with the longitudinal axis of the bore shaft;

wherein the battery/switch housing and the laser housing assembly have longitudinal end bores formed therein to provide an enclosure therebetween for a battery for powering the laser source; and wherein the battery/switch housing and the laser housing assembly have corresponding mating threads formed thereon to provide for relative longitudinal movement therebetween when rotated with respect to each other such that a terminal of the battery engages the switch assembly to activate the laser source.

2. The laser precision bore sight assembly of claim 1 wherein the compressible barrel insert is a cylinder formed of a machined plastic material.

3. The laser precision bore sight assembly of claim 1 wherein the compressible cylindrical barrel insert is rotatably mounted on the cylindrical bearing surface of a barrel insert retainer shaft which is fixed to the end of the elongated bore shaft.

4. The laser precision bore sight assembly of claim 1 wherein the compressible barrel insert is selected from a group of cylindrical barrel inserts, where each of the barrel inserts corresponds to a particular gun-barrel caliber.

5. The laser precision bore sight assembly of claim 1 wherein the laser housing assembly includes a three point laser alignment mechanism for adjusting the alignment of the laser subassembly so that the laser beam is directed along the longitudinal axes of the bore of the gun barrel when the shaft is rotated.

6. The laser precision bore sight assembly of claim 5 wherein the three-point alignment mechanism mounted to the universal housing is adjustable to align the laser subassembly and includes:

a first adjustable screw, the end of which contacts the laser subassembly and which is aligned for movement in a first direction perpendicular to the longitudinal axis of the shaft;

a second adjustable screw, the end of which contacts the laser subassembly and which is aligned for movement in a second direction perpendicular to the longitudinal axis of the shaft and orthogonal to the first direction of movement of the first adjustment screw; and a spring-loaded bushing fixed to a set screw aligned for movement in a direction to bias the laser subassembly against the first and the second adjustment screws.

7. The laser precision bore sight assembly of claim 6 wherein the first and the second adjustment screws move radially with respect to the axis of the bore shaft 16 as each is screwed into a respective central bore in a respective bonnet, each of which has external threads 210 which are threaded into threaded apertures 184, 186 in the laser housing 22.

8. The laser precision bore sight assembly of claim 6 wherein the laser subassembly includes a generally ellipsoid laser container for the laser subassembly, which laser container has a maximum diameter dimensioned to contact corresponding inner surfaces of a bore in the laser housing;

wherein the laser container has an external circumferential step into which fits an o-ring; and wherein respective unthreaded side surfaces at the ends of the first and the second screws and the side surface of the spring-loaded bushing all contact and compress the O-ring.

9. The laser precision bore sight assembly of claim 6 wherein back of the first and the second adjustment screws each includes a fine adjustment retainer ring which is connected to a respective adjustment screw and which has a number of internal detent recesses formed therein which are engaged by at least one spring-loaded ball.

10. The laser precision bore sight assembly of claim 1 wherein the battery/switch housing switch assembly is contained in a cavity formed in the battery/switch housing and wherein the electrical switch assembly includes:

a compression spring having flat ends and contained in the cavity;

a cup-shaped fiber washer with a threaded center bore formed therethrough to receive a contact pin having an end contact surface; and wherein relative twisting of the battery/switch housing with respect to the laser housing assembly provides one of the terminals of the battery engaging the switch assembly to activate the laser source.

11. A laser precision bore sight assembly for insertion into the bore of a gun for alignment of the sights and a training system, comprising:

an elongated bore shaft having a longitudinal axis and adapted to having a proximate end thereof inserted in the gun barrel;

a compressible cylindrical barrel insert which has a continuous outer surface and which is rotatably mounted to the proximate end of the shaft which continuous outer surface is adapted to resiliently engage the inside wall of the bore of the gun barrel such that the longitudinal axis of the proximate end of the shaft is coaxially aligned with the longitudinal axis of the gun barrel when the shaft is inserted and rotated in the bore of the gun barrel;

the distal end of the shaft has an alignment cone which increases distally in diameter and which is adapted to engage the peripheral edge of the bore of the gun barrel;

a laser housing assembly which is coaxially mounted adjacent to the distal end of the shaft and which contains a laser subassembly having laser source which provides a laser beam in a direction coaxial with the longitudinal axis of the shaft;

wherein the laser housing assembly includes a three point laser alignment mechanism for adjusting the alignment of the laser subassembly so that the laser beam is directed along the longitudinal axes of the shaft and the bore of the gun barrel when the shaft is rotated.

12. The laser precision bore sight assembly of claim 11 where the barrel insert is formed of a machined material.

13. The laser precision bore sight assembly of claim 12 where the machined material includes an acetal material.

14. The laser precision bore sight assembly of claim 11 wherein the barrel insert includes a cylindrical base, which is rotatably mounted to the bore shaft, and an attached radially resilient section which resiliently positions the axis of the end of the bore shaft along the longitudinal axis of the gun barrel.

15. The laser precision bore sight assembly of claim 14 wherein the radially resilient section has a peaked cylindrical area which has a maximum diameter which is greater than the diameter of the gun barrel such that when the barrel insert is inserted into the gun barrel, the external surface of peaked cylindrical area contacts the interior wall of the gun barrel and is pushed radially inwardly to conform to the smaller diameter of the gun barrel so that the peaked cylindrical area of the barrel insert snugly engages the wall of the gun barrel to precisely position the one end of the bore shaft within the gun barrel along the longitudinal axis of the gun barrel and the peaked cylindrical area of the barrel insert provides continuously contact with the inner wall of the gun barrel.

16. The laser precision bore sight assembly of claim 14 wherein the radially resilient section includes a section of the cylindrical base which has an interior diameter larger, than the interior diameter of the cylindrical base section and which has a peaked cylindrical area with a maximum diameter which is greater than the diameter of the gun barrel.

17. The laser precision bore sight assembly of claim 14 wherein the radially resilient section includes an integral radially outwardly extending support flange from which longitudinally extends an integral cantilevered resilient ring with a peaked cylindrical area with a maximum diameter which is greater than the diameter of the gun barrel, wherein the integral cantilevered resilient ring 86 is spaced apart from the main cylindrical section by having a ring-shaped space formed beneath it.

18. The laser precision bore sight assembly of claim 11 wherein the three-point alignment mechanism mounted to the universal housing for adjusting the alignment of the laser subassembly includes:

a first adjustable screw mechanism which contacts the laser subassembly and which is aligned for movement in a first direction perpendicular to the longitudinal axis of the shaft;

a second adjustable screw mechanism which contacts the laser subassembly and which is aligned for movement in a second direction perpendicular to the longitudinal axis of the shaft and orthogonal to the first direction of movement of the first adjustment screw; and a spring-loaded bushing aligned for movement in a direction to bias the laser subassembly against the first and the second adjustment screws.

19. The laser precision bore sight assembly of claim 18 wherein the three-point alignment mechanism mounted to the universal housing for adjusting the alignment of the laser subassembly includes the first and the second adjustment screw mechanisms each have a detented adjustment mechanism for providing stepped adjustments.

20. The laser precision bore sight assembly of claim 19 wherein each of the first and the second adjustment screw mechanisms each includes:

a bonnet with external threads which are formed on its lower end which are threaded into a threaded aperture in the laser housing; and an adjustment screw which engages internal threads formed in a central bore in the bonnet 196 for movement of the adjustment screw against the laser subassembly.

21. The laser precision bore sight assembly of claim 20 including an O-ring positioned around the bonnet adjacent to the laser housing to provide a waterproof seal between external threads of the bonnet and the laser housing.

22. The laser precision bore sight assembly of claim 18 wherein each of the first and the second adjustment screw mechanisms includes a fine adjustment retainer ring which has a number of pairs of internal recesses formed therein which are engaged by at least one spring-loaded ball.

23. The laser precision bore sight assembly of claim 11 including:

a battery/switch housing 20 which is coaxially mounted adjacent to the alignment cone and which contains a switch assembly;

wherein the battery/switch housing and the laser housing assembly have adjacent longitudinal end bores formed therein to provide an enclosure for a battery; and wherein the battery/switch housing and the laser housing assembly have corresponding matching threads formed thereon to provide relative longitudinal movement therebetween such that a terminal of the battery is pushed to engage the switch assembly to activate the laser source.

24. A method of aligning a laser beam along the longitudinal axis of the bore of barrel of a gun, comprising the steps of:

rotatably mounting a cylindrical barrel insert, which has a flexible outer cylindrical surface, to one end of a bore shaft having a longitudinal axis;

inserting the cylindrical barrel insert into the bore of the gun barrel having a longitudinal axis and engaging the inside wall of the gun barrel bore with the outer cylindrical surface of the cylindrical barrel insert;

engaging an alignment cone located at the outer end of the shaft with the outer inside edge of the gun barrel such that the longitudinal axis of the shaft is coaxially aligned with the longitudinal axis of the gun barrel when the shaft is inserted and rotated in the gun barrel;

mounting a laser housing, which contains a laser source assembly, adjacent to the outer end of the shaft;

directing a laser beam from the laser source assembly in a direction coaxial with the longitudinal axis of the shaft; and adjusting a three-point laser alignment mechanism mounted to the universal housing for adjusting the alignment of the laser beam along the longitudinal axes of the shaft and the bore of the gun barrel, even when the shaft is rotated.

25. The method of claim 24 wherein the step of adjusting the three point laser alignment mechanism is performed by adjusting a first adjustment screw mechanism which is aligned for movement in a first direction perpendicular to the longitudinal axis of the shaft, adjusting a second adjustment screw mechanism which is aligned for movement in a second direction perpendicular to the longitudinal axis of the shaft and orthogonal to the first direction of movement of the first adjustment screw; and biasing a spring-loaded bushing aligned for movement in a direction which bias the laser subassembly against the first and the second adjustment screws.

26. The method of claim 25 wherein the steps of adjusting the first and the second adjustment screw mechanisms include manual adjusting by a user.

27. The method of claim 24 wherein the step of inserting the cylindrical barrel insert into the bore of the gun barrel includes selecting a cylindrical barrel insert which is one of a number of barrel inserts, each of which corresponds to various gun barrel calibers.

28. The method of claim 27 wherein the step of inserting the cylindrical barrel insert into the bore of the gun includes providing the barrel insert as a durable, precision machined plastic part to avoid damage to the interior surface and the rifling in the gun barrel.

29. The method of claim 24 including a step of containing a battery within the laser housing and a battery/switch housing connecting terminals of the battery to the laser source by rotating the laser housing with respect to the battery/switch housing.

30. The method of claim 24 including the step of aligning a gun sight of the gun after adjusting the three-point laser alignment mechanism with respect to the laser beam.

31. The method of claim 24 including the step of aligning a firearm training system concentric with respect to the laser beam.

32. An adjustably aligned laser housing assembly, comprising:

a housing having a first bore formed therein;

a generally ellipsoidal laser container into which is fixed a laser source for a reference laser beam aligned along a longitudinal axis, said laser container having a maximum diameter dimensioned to contact corresponding inner surfaces of the first bore, an O-ring radially positioned around the longitudinal axis of the laser container;

a three-point laser alignment mechanism for adjusting the alignment of the laser container with respect to the housing, wherein the laser alignment mechanism includes:

a first adjustable screw, the lower end of which contacts the laser subassembly and which is aligned for movement in a first direction perpendicular to the longitudinal axis of the shaft;

a second adjustable screw, the lower end of which contacts the laser subassembly and which is aligned for movement in a second direction perpendicular to the longitudinal axis of the shaft and orthogonal to the first direction of movement of the first adjustment screw;

wherein unthreaded, smooth side surfaces at the lower end of the adjustment screws contact the O-ring to provide friction loading on the ends of the adjustment screws; and a spring-loaded bushing fixed to a set screw aligned for movement in a direction to bias the laser subassembly against the first and the second adjustment screws.

33. The adjustably aligned laser housing assembly of claim 32 wherein the first and the second adjustable screws are each provided with a bonnet with external threads which are threaded into a corresponding threaded aperture in the laser housing and wherein each of the adjustable screw engages internal threads formed in a central bore in the bonnet 196 for movement of the adjustment screw against the laser subassembly 122.

34. The adjustably aligned laser housing assembly of claim 33 further including a water proofing O-ring positioned around the external threads of the bonnet adjacent to the laser housing to provide a waterproof seal between the external threads of the bonnet and the laser housing.

35. The adjustably aligned laser housing assembly of claim 33 wherein each adjustable screw and associated bonnet includes a fine adjustment retainer ring which has a number internal recesses 230 formed therein which are engaged by at least one spring-loaded ball mounted to the bonnet.

36. A laser precision bore sight assembly for bore sight alignment of a laser beam the along longitudinal axis of a gun barrel, comprising:

an elongated bore shaft having a longitudinal axis and adapted to having a proximate end thereof inserted into the bore of the gun barrel;

a compressible barrel-shaped insert which is rotatably mounted to the proximate end of the bore shaft and which has a continuous outer surface which is adapted to be inserted in the gun barrel to resiliently engage the inside wall of the gun barrel such that a longitudinal axis of approximate end of the bore shaft is coaxially aligned with the longitudinal axis of the gun barrel;

at the distal end of the bore shaft is provided a rotational mount for mounting the distal end of the bore shaft to the distal end of the gun barrel to coaxially align a distal end of the bore shaft with the longitudinal gun of the barrel; and a laser housing assembly which is coaxially mounted to the distal end of the bore shaft and which contains a laser subassembly having a laser source which provides a laser beam in a direction coaxial with the longitudinal axis of the bore shaft.

37. The laser precision bore sight assembly of claim 36 wherein the rotational mount for mounting the distal end of the bore shaft to the distal end of the gun barrel includes an alignment cone which has an external distally increasing conical surface which is adapted to engage a distal inner edge of the gun barrel in order to coaxially align the distal end of the bore shaft for rotation about the longitudinal axis of the gun barrel.

38. The laser precision bore sight assembly of claim 36 including a three-point alignment mechanism for adjusting the alignment of the laser subassembly so that the laser beam is adjustable to be directed along the longitudinal axis of the bore of the gun barrel when the bore shaft is rotated.

* * * * *